US009211720B2

(12) United States Patent
Boyd et al.

(10) Patent No.: US 9,211,720 B2
(45) Date of Patent: Dec. 15, 2015

(54) FLUID CONTAINER HAVING FIRST AND SECOND KEY SET

(75) Inventors: Patrick V. Boyd, Albany, OR (US); Melissa S. Gedraitis, Camas, WA (US); Jeffrey A. Mueller, Corvallis, OR (US); Judson Leiser, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 71 days.

(21) Appl. No.: 13/884,303

(22) PCT Filed: Nov. 30, 2010

(86) PCT No.: PCT/US2010/058323

§ 371 (c)(1),
(2), (4) Date: May 9, 2013

(87) PCT Pub. No.: WO2013/115753

PCT Pub. Date: Aug. 8, 2013

(65) Prior Publication Data

US 2014/0192119 A1 Jul. 10, 2014

(51) Int. Cl.
*B41J 2/175* (2006.01)

(52) U.S. Cl.
CPC ..... *B41J 2/1752* (2013.01); *B41J 2/1755* (2013.01); *B41J 2/17553* (2013.01)

(58) Field of Classification Search
None
See application file for complete search history.

(56) References Cited

U.S. PATENT DOCUMENTS 4,907,019 A 3/1990 Stephens
5,519,422 A * 5/1996 Thoman et al. ..... 347/49
6,123,421 A * 9/2000 Bartolome et al. ..... 347/87
7,476,314 B2 1/2009 Reid
2002/0041314 A1 4/2002 Santhanam et al.

(Continued)

FOREIGN PATENT DOCUMENTS

| | | |
|---|---|---|
| CN | 1396864 | 2/2003 |
| CN | 101600577 | 12/2009 |
| EP | 878307 | 11/1998 |
| EP | 1114724 | 7/2001 |
| EP | 1431042 | 6/2004 |
| JP | H09174879 | 7/1997 |
| KR | 102009011384 | 11/2009 |

OTHER PUBLICATIONS

Korean Intellectual Property Office, PCT Notification of Transmittal of the International Search Report and the Written Opinion of the International Searching Authority, or the Declaration for PCT/US2010/058323 dated Aug. 13, 2013 (16 pages).
The International Bureau of WIPO, International Preliminary Report on Patentability for PCT/US2010/058323 dated Sep. 12, 2013 (6 pages).

*Primary Examiner* — Stephen Meier
*Assistant Examiner* — Bradley Thies
(74) *Attorney, Agent, or Firm* — Hewlett-Packard Patent Department

(57) ABSTRACT

A fluid container usable with an image forming apparatus including a receiving unit having a plurality of receiver slots is disclosed. The fluid container includes a housing unit including a plurality of wall portions and a fluid chamber to store fluid therein. The housing unit is to removably attach to a respective receiver slot of the receiving unit. The fluid container includes a first key set disposed on an exterior surface of one wall portion of the housing unit. The first key set is to form a first key pattern corresponding to a conforming first receiver key pattern of a respective receiver slot. The fluid container includes a second key set disposed on an exterior surface of an other wall portion of the housing unit. The second key set is to form a second key pattern corresponding to a conforming second receiver key pattern of the respective receiver slot.

20 Claims, 8 Drawing Sheets

(56) References Cited

U.S. PATENT DOCUMENTS

| | | | | |
|---|---|---|---|---|
| 2002/0094208 | A1 | 7/2002 | Palumbo | |
| 2004/0070652 | A1 | 4/2004 | Haldorsen | |
| 2004/0183873 | A1* | 9/2004 | Steinmetz et al. | 347/86 |
| 2004/0218025 | A1 | 11/2004 | Haldorsen | |
| 2006/0162305 | A1 | 7/2006 | Reid | |
| 2008/0036827 | A1 | 2/2008 | Anderson et al. | |
| 2009/0189962 | A1* | 7/2009 | Huck et al. | 347/86 |
| 2010/0103230 | A1 | 4/2010 | Anderson et al. | |
| 2011/0057999 | A1* | 3/2011 | Gonzales | 347/86 |
| 2012/0001990 | A1* | 1/2012 | Rittgers et al. | 347/86 |

* cited by examiner

FLUID CONTAINER HAVING FIRST AND SECOND KEY SET

BACKGROUND

Fluid containers are used to store fluid therein and supply the fluid to a respective fluid applicator such as a print head of an image forming apparatus. The fluid may be ejected from the print head onto a recording medium. The fluid containers may contain various colors of ink, respectively, and be removably installed in a respective receiver slot of a receiving unit of the image forming apparatus. The fluid containers may include a key set forming a key pattern conforming to a receiver key pattern of the respective receiver slot of the receiving unit. The key pattern and corresponding conforming receiver key pattern assists in having a respective fluid container containing an appropriately-colored fluid installed in the appropriate receiver slot of the receiving unit of the image forming apparatus.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

Throughout the drawings, identical reference numbers designate similar, but not necessarily identical, elements.

DETAILED DESCRIPTION

Figure 1:
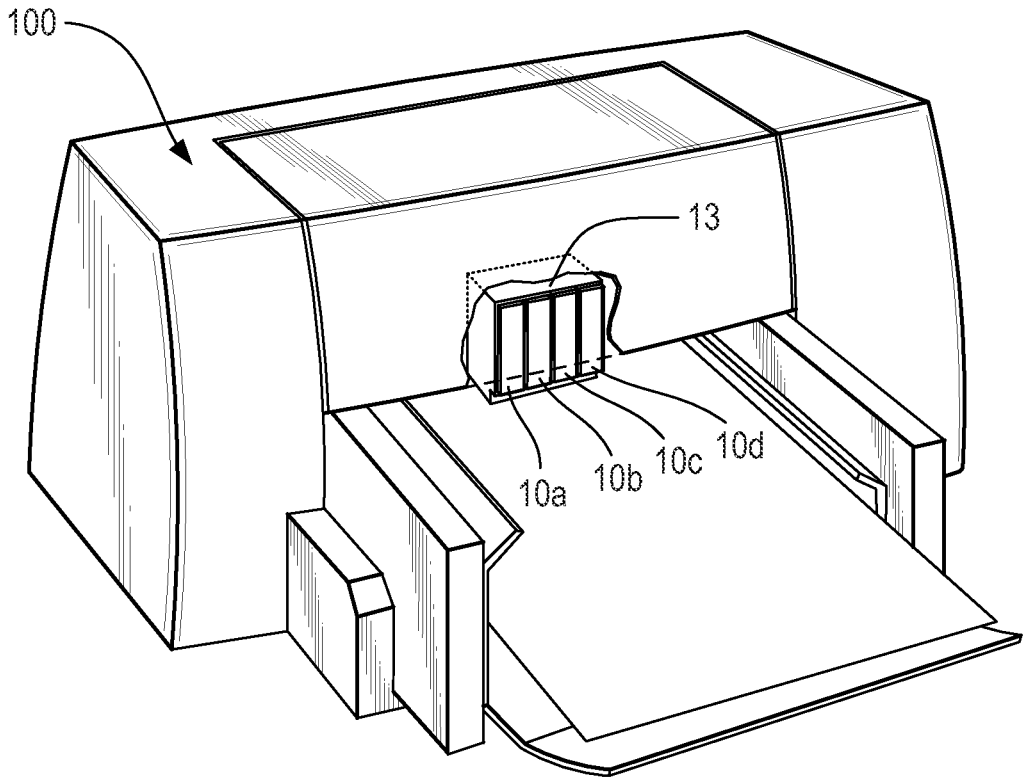
FIG. 1 is a perspective view of fluid containers installed in respective receiver slots of a receiving unit of an image forming apparatus according to an example of the present disclosure.

In the following detailed description, reference is made to the accompanying drawings which form a part hereof, and in which is illustrated by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Fluid containers contain various colors of fluid such as cyan ink, yellow ink, magenta ink, black ink, and the like, respectively. Fluid containers may be removably installed and/or attached to a respective receiver slot of a receiving unit of an image forming apparatus such as an inkjet printer. A respective fluid container may include a key set having a key pattern that conforms to a receiver key pattern of the respective receiver slot of the receiving unit. The key set may correspond to a particular color of the fluid stored in a fluid container as well as the conforming receiver key pattern of the respective receiver slot to receive the fluid container. Thus, a fluid container containing one color of fluid, for example, yellow ink, is not inadvertently installed in a respective receiver slot configured to receive a fluid container containing another color of ink, for example, black ink.

Generally, however, the key set may be disposed on the fluid container in a manner in which a user may not be alerted in an early stage of the fluid container installation process of the nonconformity between the fluid container with respect to its respective color of fluid stored therein and the receiver slot. That is, nonconformity between the key set and the receiver key pattern may not be identified during installation of the fluid container until it is well within the respective receiver slot. At such time, the fluid container may be inadvertently wiggled and/or manipulated to allow a faulty installation of the fluid container in which improper fluid communication is established between the fluid container and the image forming apparatus. Such fluid communication, even for a short period of time, may damage the image forming apparatus due to exposure to fluid having an incompatible chemistry therewith.

In the present disclosure, faulty installation of the fluid container and/or improper fluid communication between the fluid container and the image forming apparatus is restricted. In examples of the present disclosure, a first key set and a second key set are disposed on the fluid container in a manner in which nonconformity is determined early on in the fluid container installation process between the receiver slot and the fluid container based on an inappropriate color of fluid being stored therein. That is, nonconformity between the first key set and the first receiver key pattern is identified before the fluid container is well within the receiver slot. Further, a second key set restricts the establishment of improper fluid communication between the fluid container and the image forming apparatus with fluid having incompatible chemistry damaging to the image forming apparatus. In examples, the second key set is disposed adjacent to a port located on a respective wall portion of the housing unit. Thus, in the present disclosure, inadvertent engagement of the port and establishment of an improper fluid communication is restricted.

FIG. 1 is a perspective view of fluid containers installed in respective receiver slots of a receiving unit of an image forming apparatus according to an example of the present disclosure. In the present example, the fluid containers 10*a*, 10*b*, 10*c* and 10*d* (collectively "10") store various colors of fluid thereon. For example, a first fluid container 108 contains yellow ink, a second fluid container 10*b* contains magenta ink, a third fluid container 10*c* contains cyan ink and a fourth fluid container 10*d* contains black ink. The fluid containers 10 are removably installed and/or attached to a receiving unit 13 of an image forming apparatus 100. In the present example, the fluid containers 10 may be removable ink cartridges, or the like, and the image forming apparatus 100 may be an inkjet printer. Accordingly, a respective fluid container 10 may be replaced when necessary such as when the fluid contained therein is exhausted. In the present example, the fluid containers 10 do not include an integrated print head therein and the receiving unit 13 is stationary. In other examples, however, the fluid containers 10 may include an integrated print head and the receiving unit 13 such as a carriage may reciprocate across a recording medium feed into the image forming apparatus 100.

Figure 2:
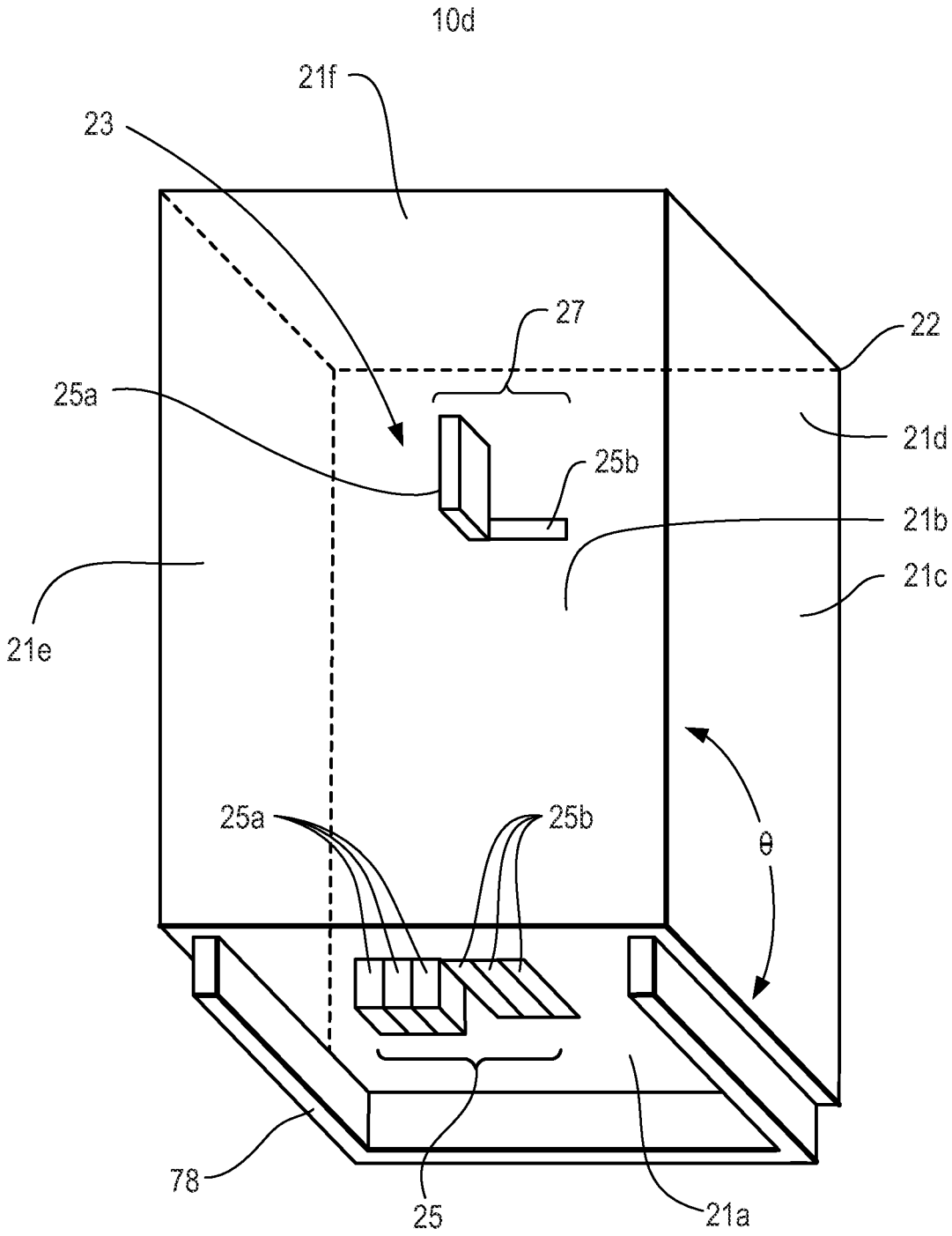
FIG. 2 is a perspective view of a fluid container according to an example of the present disclosure.
Figure 3:
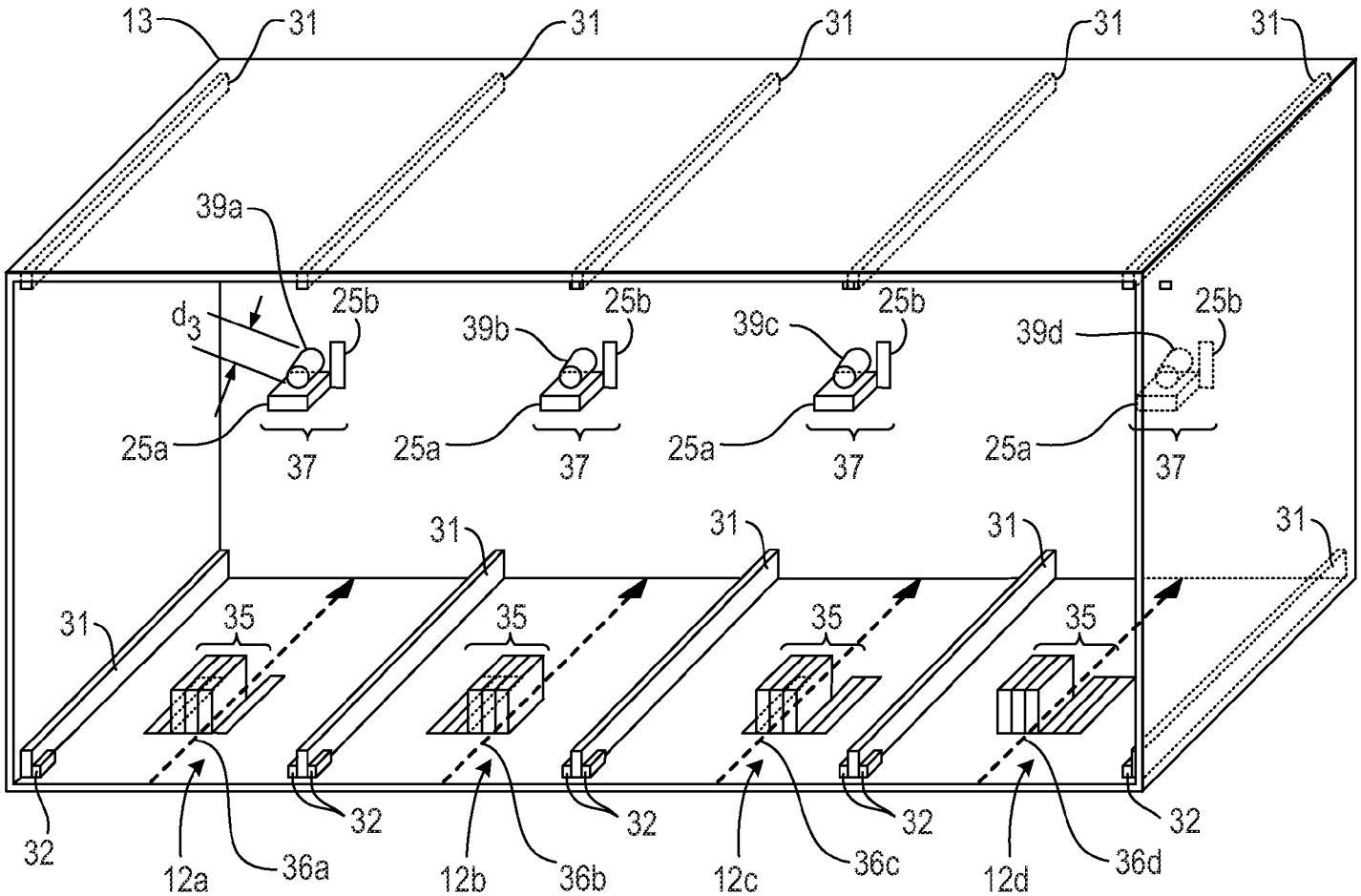
FIG. 3 is a perspective view of a receiving unit including receiver slots to receive fluid containers, respectively, according to an example of the present disclosure.

FIG. 2 is a perspective view of a fluid container according to an example of the present disclosure. FIG. 3 is a perspective view of a portion of a receiving unit including receiver slots to receive fluid containers, respectively, according to an example of the present disclosure. Referring to FIGS. 2 and 3, a fluid container 10*d* is usable with an image forming apparatus 100 including a receiving unit 13 having a plurality of receiver slots 12*a*, 12*b* 12*c* and 12*d* (collectively "12"). In the present example, the fluid container 10*d* includes a housing unit 22, a fluid chamber 23, a first key set 25, and a second key set 27. The housing unit 22 includes a plurality of wall portions 21*a*, 21*b*, 21*c*, 21*d*, 21*e* and 21*f* (collectively "21") and is configured to removably attach to a respective receiver slot 12 of the receiving unit 13 of the image forming apparatus 100. In examples, each of the fluid containers 10 may include a plurality of fluid chambers 23 therein.

Referring to FIG. 3, in an example, the receiving unit 13 of the image forming apparatus 100 includes a plurality of receiver slots 12*a*, 12*b*, 12*c* and 12*d*, first receiver key sets 35, second receiver key sets 37, installation paths 36*a*, 36*b*, 36*c* and 36*d* (collectively "36"), port engagement members 39*a*, 39*b*, 39*c* and 39*d* (collectively "39"), housing guides 31 and keying guides 32. Each of the respective receiver slots 12 are configured to receive a fluid container 10 containing an appropriately-colored fluid through the use of first receiver key sets 35 and a fluid container associated with an appropriate fluid container family through the use of second receiver key sets 37. A respective installation path 36 is disposed inside each of the receiver slots 12 for the respective fluid containers 10 to proceed along during installation thereof.

Each of the port engagement members 39 engages a respective port 77 (FIG. 6) of the fluid container 10 upon proper installation of the respective fluid container 10. The receiving unit 13 may also include housing guides 31 and keying guides 32 to guide the fluid container 10*d* into the receiver slot 12*d* during installation of the fluid container 10*d*. In an example, the housing guides 31 are configured to engage respective wall portions 12 of the housing unit 22 and guide the fluid container 10*d* along the installation path 36*d* during installation thereof. In an example, the keying guides 32 are configured to engage a portion of the housing unit 22 and the guide member 78 to restrict unwanted movement as the respective key sets approach each other due to movement of the fluid container 10 along the respective installation path 36*d*.

Figure 4:
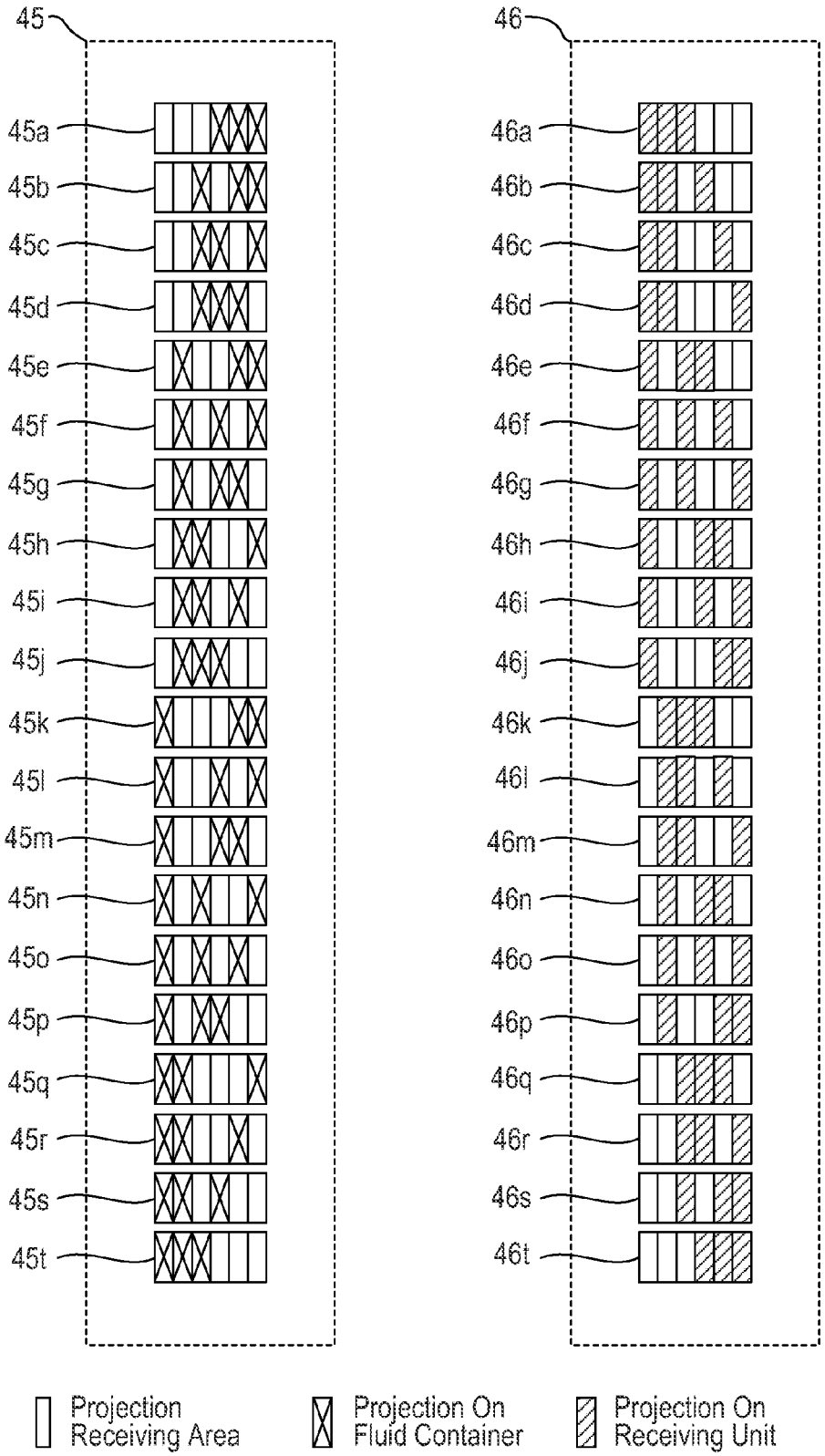
FIGS. 4 and 5 are diagrams illustrating respective key patterns according to an example of the present disclosure.
Figure 5:
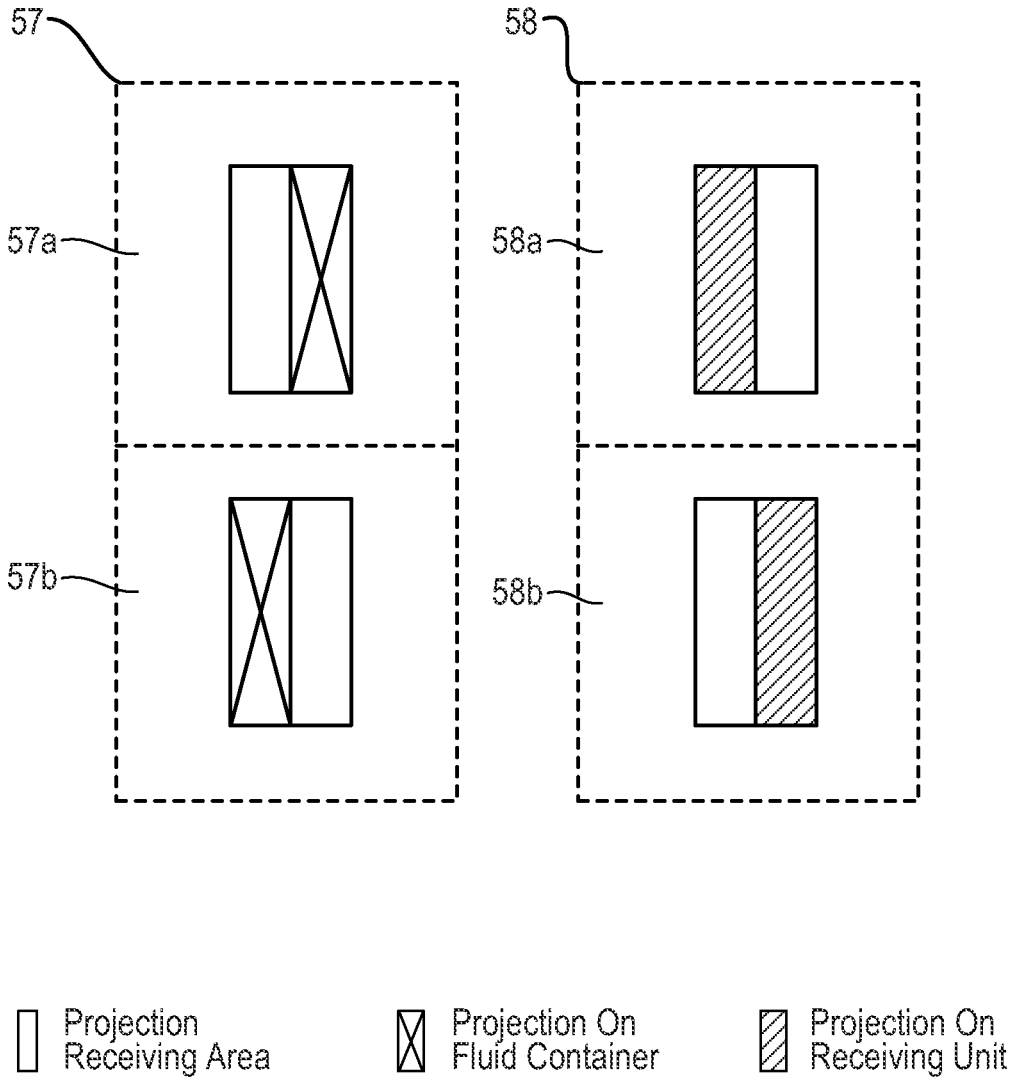

FIG. 4 is a diagram illustrating first key patterns and first receiver key patterns according to an example of the present disclosure. FIG. 5 is a diagram illustrating second key patterns and second receiver key patterns according to an example of the present disclosure. The respective key patterns 45 and 46 and the respective key patterns 57 and 58 are represented in FIGS. 4 and 5, respectively, as viewed from a rear perspective view of the leading end (e.g., the other wall portion 21*b*) of the housing unit 22 installed in the receiving unit 13 (FIG. 7A) and front elevation view of the receiving unit 13 with the fluid container 10*d* installed therein (FIG. 7B). Referring to FIGS. 2-5, the first key set 25 is disposed on an exterior surface of one wall portion 21*a* of the housing unit 22. The first key set 25 is configured to form a first combination key pattern 45*a* (FIG. 4) corresponding to a conforming first combination receiver key pattern 46*a* of a respective receiver slot 12 formed by a first receiver key set 35 thereon. The second key set 27 is disposed on an exterior surface of an other wall portion 21*b* of the housing unit 22.

Figure 7A:
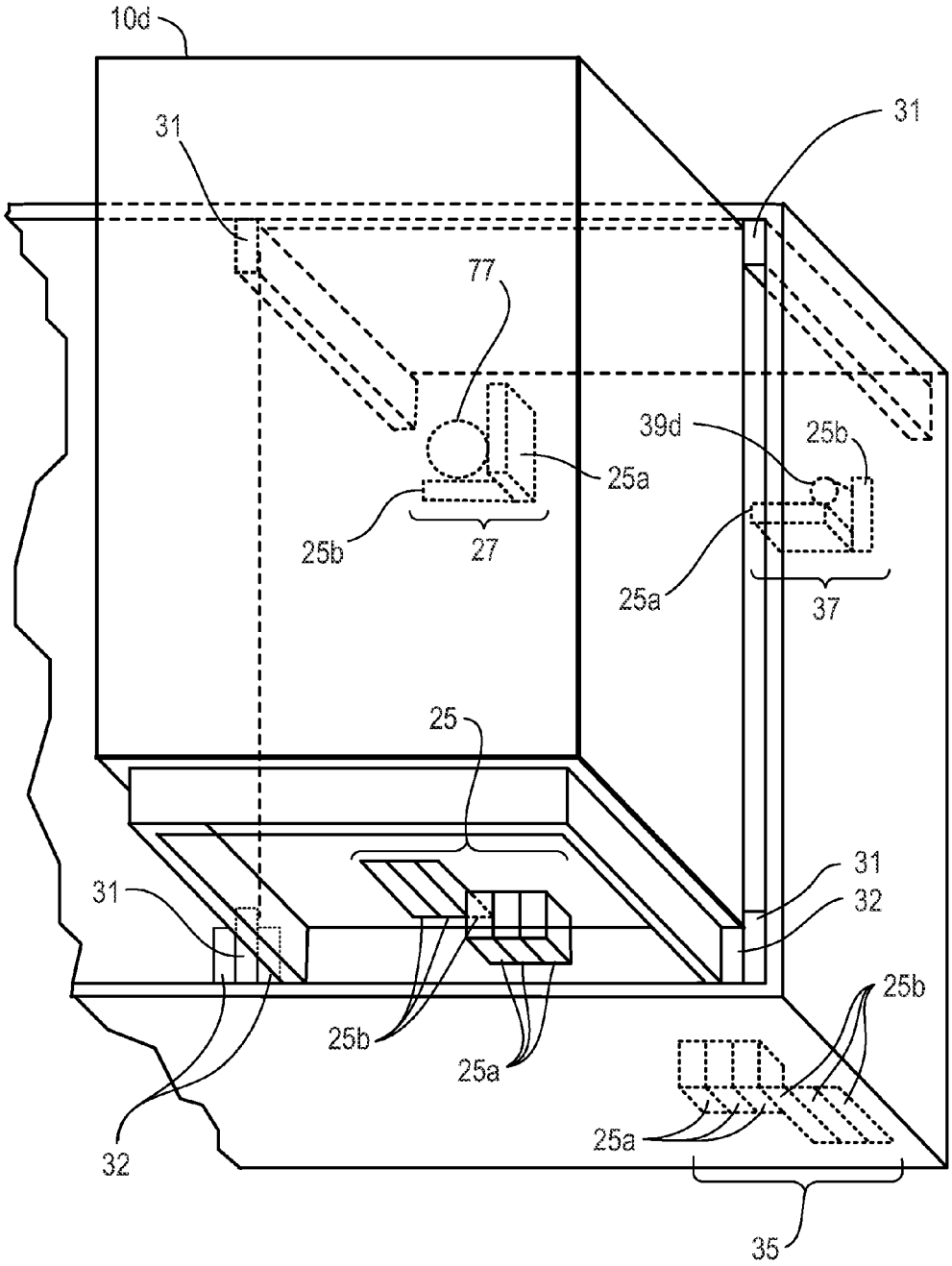
FIG. 7A is a perspective view of the fluid container of FIG. 6 to be installed in a receiving unit of an image forming apparatus according to an example of the present disclosure.
Figure 7B:
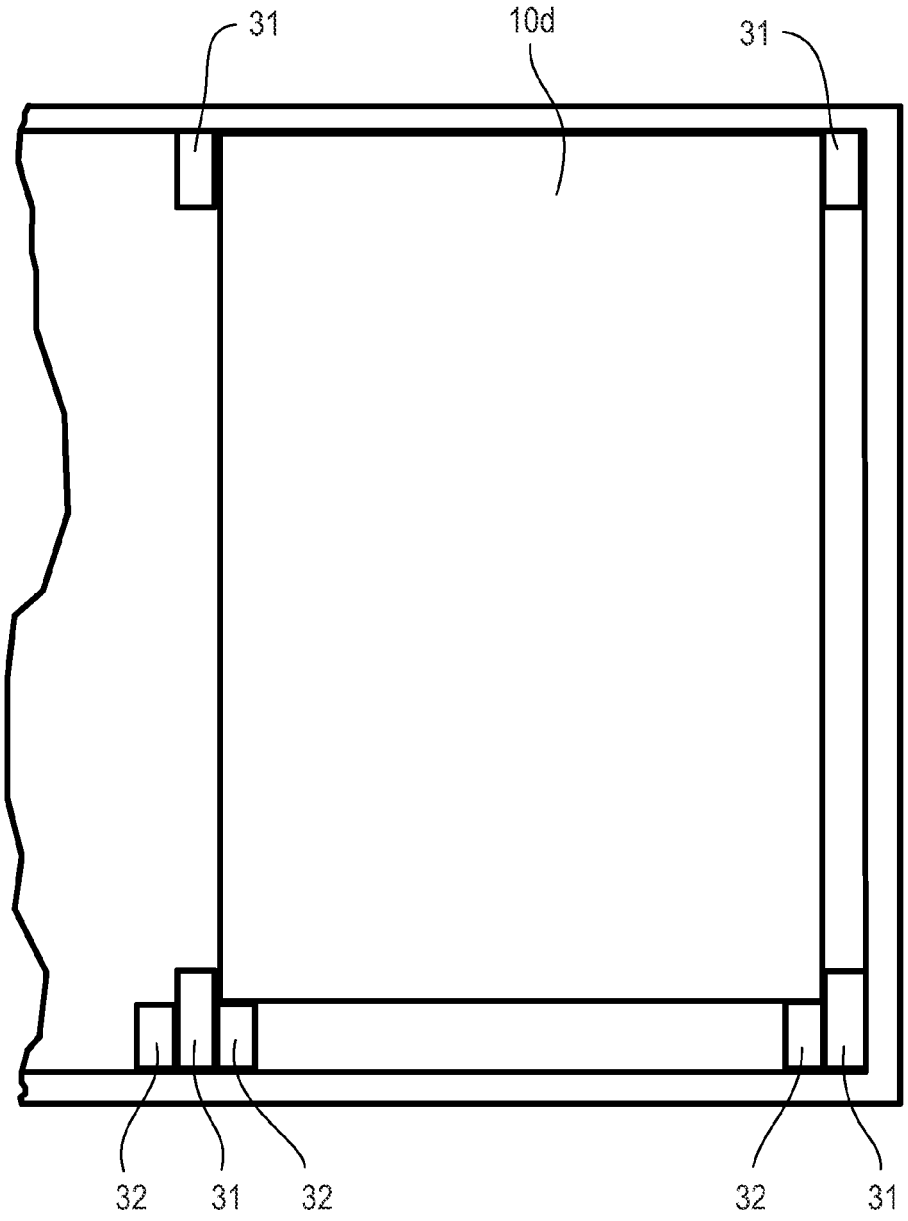
FIG. 7B is a front elevation of a portion of the receiving unit with the fluid container installed therein according to an example of the present disclosure.

The other wall portion 21*b* is a leading end of the housing unit 22 in the fluid container installation (FIG. 7A). In the present example, the one wall portion 21*a* and the other wall portion 21*b* of the housing unit 22 form an angle θ with each other. For example, the respective wall portions 21*a* and 21*b* may be approximately perpendicular to each other. The angle θ between the one wall portion 21*a* and the other wall portion 21*b*, for example, may be in a range of eighty-five to ninety-five degrees. In the present example, a shape of the housing unit 22 is rectangular. In other examples, the housing unit 22 may include shapes other than rectangular.

Referring to FIGS. 2-5, the second key set 27 is configured to form a second combination key pattern 57*a* (FIG. 5) corresponding to a conforming second combination receiver key pattern 58*a* of the respective receiver slot 12 formed by a second receiver key set 37 thereon. In an example, the respective key sets 25 and 27 may include at least one of one or more projections 25*a* and one or more projection receiving areas 25*b*. A projection 25*a*, for example, may be a member having a predetermined size and extending outward from a respective surface. A projection receiving area 25*b*, for example, may be an area, space, channel, path, recess, opening, or the like, having a predetermined size to receive and/or provide an unobstructed path for a corresponding projection 25*a* to enter and/or continue to proceed along a respective installation path 36. Accordingly, in examples, respective key patterns 45, 46, 57 and 58 include a combination and/or sequence including at least one of one or more projections 25*a* and one or more projection receiving areas 25*b*. In the present example, the first key set 25 may include three projections 25*a* and three projection receiving areas 25*b*. Accordingly, in the present example, respective key patterns 45 and 46 (FIG. 4) include a combination and/or sequence including three projections 25*a* and three projection receiving areas 25*b*.

Referring to FIGS. 2-5, a total of twenty unique key patterns 45 exist in the case where the respective key patterns 45 and 46 include a combination and/or sequence including three projections 25*a* and three projection receiving areas 25*b* as illustrated in FIGS. 4 and 7A. For example, the first combination key pattern 45*a* corresponds to the first key pattern 45 formed by the first key set 25 of the fluid container 10*d*. That is, the first combination key pattern 45*a* includes a sequence of an initial three adjacent projections 25*a* followed by three adjacent projection receiving areas 25*b* as viewed from a rear perspective view of the leading end (e.g., the other wall portion 21*b*) of the housing unit 22 installed in the receiving unit 13 (FIG. 7A).

A respective conforming receiver key pattern 46 of the receiving unit 13 is a combination and/or sequence of at least one or more projections 25*a* and one or more projection receiving areas 25*b* complementary to the respective key pattern 45 of the fluid container 10. Accordingly, the respective conforming first combination receiver key pattern 46*a* (complement of the first combination key pattern 45*a* previously described) is a sequence of an initial three adjacent projection receiving areas 25*b* followed by three adjacent projections 25*a* as viewed from a front elevation view of the receiving unit 13 (FIG. 7B). In examples, the respective projections 25*a* of the first key set 25 on the fluid container 10 may over travel with respect to respective projections 25*a* of the first receiver key set 35 for conforming key sets.

Consequently, a conforming receiver key pattern 46 and 58 allows the respective key set 25 and 27 to engage and/or continue past the respective receiver key set 35 and 37 along a respective installation path 36. Thus, if both the first receiver key set 35 and second receiver key set 37 are in conformity, the fluid container 10 may proceed along the respective installation path 36 in its entirety and properly attach to the receiving unit 13 resulting in a proper installation. In the present example, the first key pattern 45 corresponds to a respective color of the fluid stored in the fluid container 10. Thus, for example, the fluid containers 10*a* containing yellow ink will each have the same first key pattern 45. Also, in an example, at least a portion of the first key set 25 may be color-coded to correspond to a respective color of fluid in the respective fluid chamber 23. Thus, for example, the projections 25*a* of the first key set 25 corresponding to the fluid containers 10*a* containing yellow ink may be colored yellow, and so on.

In the present example, the second key pattern 57 (FIG. 5) corresponds to a respective fluid container family. For example, a fluid container family may be a group of fluid containers containing fluids having a compatible chemistry with respect to a particular image forming apparatus or group of image forming apparatuses. Accordingly, in an example, fluid containers 10*a* containing yellow ink will all have the same first key pattern 45, but will have a different second receiver key pattern therefrom if they correspond to a different fluid container family.

Figure 6:
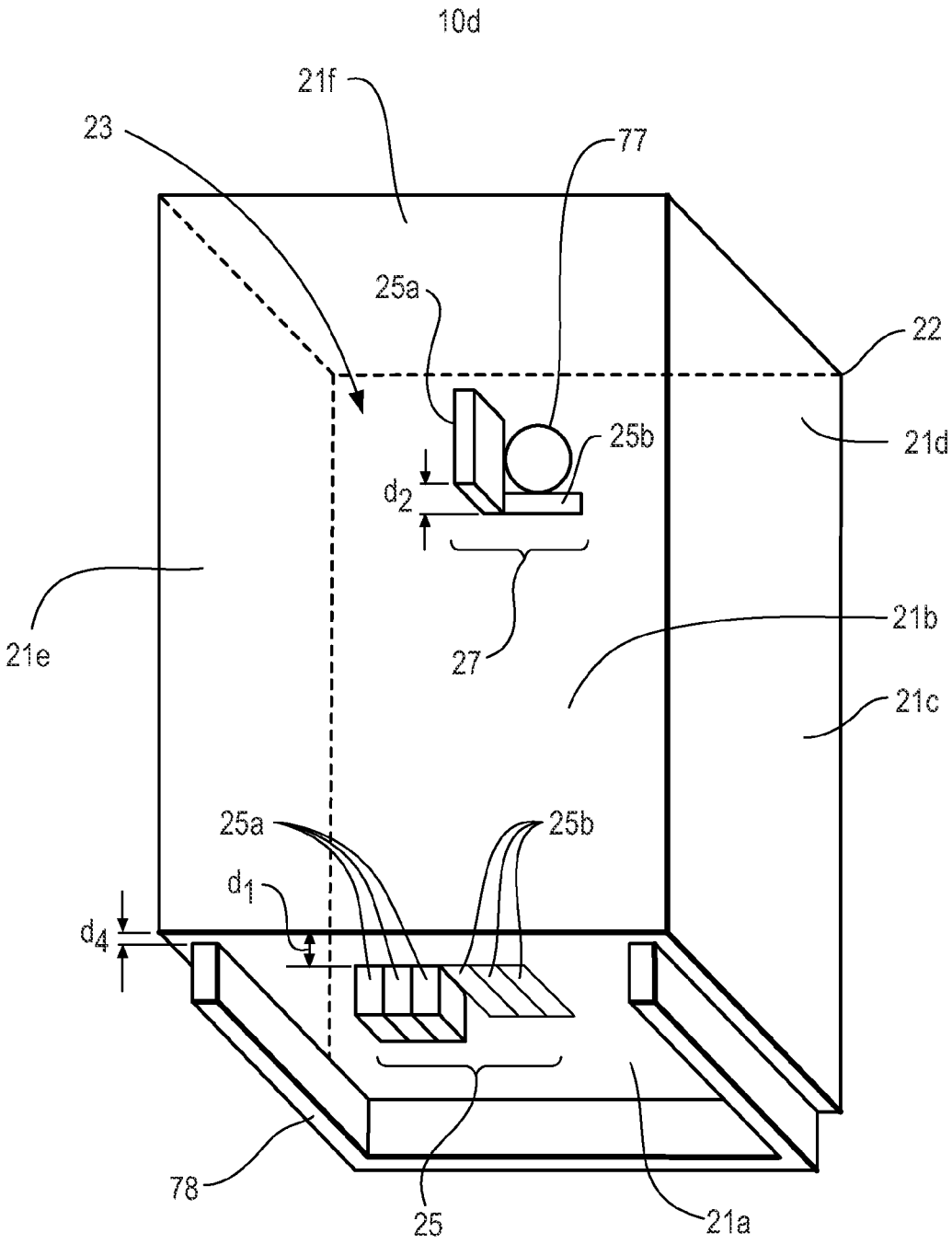
FIG. 6 is a perspective view of the fluid container of FIG. 2 according to an example of the present disclosure.

FIG. 6 is a perspective view of the fluid container of FIG. 2 according to an example of the present disclosure. FIG. 7A is a perspective view of the fluid container of to be installed in a receiving unit of an image forming apparatus according to an example of the present disclosure. FIG. 7B is a front elevation of a portion of a receiving unit with the fluid container installed therein according to an example of the present disclosure. Referring to FIGS. 6-7B, in the present example, the fluid container 10*d* may also include a port 77 and a guide member 78. In examples, the fluid container 10*d* may include a plurality of ports 77 and a plurality of guide members 78. The port 77 such as a fluid interconnect may be disposed on the other wall portion 21*b* of the housing unit 22 adjacent to the second key set 27. The port 77 may be configured to engage a respective port engagement member 39*d* (FIG. 3) and to provide fluid communication between the fluid chamber 23 and the port engagement member 39*d*. For example, engagement between the port 77 and the port engagement member 39*d* may allow fluid to flow between the image forming apparatus 100 and the fluid chamber 23.

Referring to FIGS. 6-7B, the second key set 27 may include a projection 25*a* and a projection receiving area 25*b* disposed adjacent to the port 77 and oriented approximately perpendicular to each other as illustrated in FIG. 6. In an example, the distance $d_2$ in which the projection 25*a* extends outward from the other wall portion 21*b* corresponds to a distance to restrict engagement between the port 77 and the port engagement member 39*d* when the second receiver key set pattern 58 is not in conformity. In an example, the distance $d_2$ may be greater than the distance $d_3$ that the port engagement member 39*d* extends outward from the receiver unit 13. Thus, if the respective second receiver key pattern 58 (FIG. 5) does not conform to the second key set 27, improper engagement of the port engagement member 39*d* with the port 77 is restricted by the second key set 27, even if the first key set 25 and the first receiver key pattern 46 are in conformity. For example, the respective projection 25*a* of the second key set 27 may contact a nonconforming projection 25*a* of the second receiver key set 37 preventing engagement between the port 77 and the port engagement member 39*d*.

Referring to FIGS. 6-7B, in an example, the guide member 78 is disposed on the one wall portion 21*a* of the housing unit 22. The guide member 78 is configured to engage the respective receiver slot 12*d* and guide the housing unit 22 therein during installation of the fluid container 10*d* in the receiving unit 13. In an example, the other wall portion 21*b* of the housing unit 22 is positioned closer to at least a portion of the guide member 78 than the other wall portion 21*b* is to the first key set 25 as illustrated in FIG. 6. That is, a distance $d_1$ between the first key set 25 and the other wall portion 21*b* is greater than a distance $d_4$ between the portion of the guide member 78 and the other wall portion 21*b*. In an example, the distance $d_4$ between the portion of the guide member 78 and the other wall portion 21*b* may be approximately zero.

Referring to FIGS. 6-7B, during the fluid container installation process, the fluid container 10 is inserted into a respective receiver slot 12. The guide member 78 of the housing unit 22 engages the receiver slot 12 and the keying guides 32 therein. In addition, respective wall portions of the housing unit 22 engage the housing guides 31. As the fluid container 10 continues along the respective installation path 36, it is guided by the respective housing guides 31 and keying guides 32.

At one point, the first key set 25 and the first receiver key set 35 approach each other. If the respective key patterns 45 and 46 are in conformity, the fluid container 10 proceeds along the respective installation path 36*d* until the second key set 27 and the second receiver key set 37 approach each other. If the respective key patterns 57 and 58 are in conformity, the fluid container 10 continues along the respective installation path 36 until the port 77 engages the respective port engagement member 39*d* and establishes fluid communication between the fluid chamber 23 and the image forming apparatus 100. Also, in the present example, the second key set 27 and the second receiver key set 37 engage each other. For example, the respective projection receiving area 25*b* of the second receiver key set 37 of the receiving unit 13 may be recessed to allow the respective projections to be inserted therein. Thus, completion of the fluid container installation is attained. If, however, either of the respective key patterns associated with the first key set 25 and the second key set 27 are not in conformity, completion of the fluid container installation is not attained. Thus, a faulty installation is restricted and no fluid communication is established between the fluid chamber 23 and the image forming apparatus 100.

Accordingly, the inclusion and positioning of the first key set 25 and the second key set 27 on the respective wall portions 21*a* and 21*b* of the fluid container 10 reduces faulty installations due to fluid containers 10 containing inappropriately-colored fluid and fluid containers 10 associated with inappropriate fluid container families. This may be accomplished, in part, by alerting a user in an early stage of the fluid container installation process of nonconformity between the fluid container 10 with respect to its respective color of fluid stored therein and the receiver slot 12. This may also be accomplished, in part, by also restricting at a later stage of the fluid container installation process improper fluid communication between the fluid container 10 and the image forming apparatus 100.

The present disclosure has been described using non-limiting detailed descriptions of examples thereof that are provided by way of example and are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples that are illustrative and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A fluid container usable with an image forming apparatus including a receiving unit having a plurality of receiver slots, the fluid container comprising:

a housing unit including a plurality of wall portions and a fluid chamber configured to store fluid therein, the housing unit configured to removably attach to a respective receiver slot of the receiving unit of the image forming apparatus;

a first key set disposed on an exterior surface of one wall portion of the housing unit, the first key set configured to form a first key pattern corresponding to a conforming first receiver key pattern of a respective receiver slot; and a second key set disposed on an exterior surface of an other wall portion of the housing unit, the second key set configured to form a second key pattern corresponding to a conforming second receiver key pattern of the respective receiver slot, wherein the one wall portion and the other wall portion of the housing unit are joined together at an angle, wherein the fluid container is to be installed along a linear installation path into the respective receiver slot, wherein the other wall portion including the second key set is to be a first portion of the fluid container to enter the respective receiver slot during installation along the linear installation path of the fluid container, wherein, before completion of the linear installation path of the fluid container, the first key pattern is to engage and continue past the first receiver key pattern, wherein the second key pattern is to fully engage the second receiver key pattern upon the completion of the linear installation path of the fluid container, and wherein the linear installation path of the fluid container is a straight line into the respective receiver slot.

2. The fluid container according to claim 1, wherein the first key pattern corresponds to a respective color of the fluid stored in the fluid container and the second key pattern corresponds to a respective fluid container family.

3. The fluid container according to claim 1, wherein the first key set comprises at least one of one or more projections and one or more projection receiving areas to conform to the conforming first receiver key pattern and the second key set comprises at least one or more projections and one or more projection receiving areas to conform to the conforming second receiver key pattern.

4. The fluid container according to claim 3, wherein each of the first key set and the conforming first key pattern comprises a combination of three projections and three projection receiving areas such that the three projections of the first key set correspond to the three projection receiving areas of the respective receiver slot of the receiving unit, respectively, and the three projection receiving areas of the first key set correspond to the three projections of the respective receiver slot of the receiving unit, respectively.

5. The fluid container according to claim 4, further comprising:

a port disposed on the other wall portion of the housing unit adjacent to the second key set, wherein the port is configured to engage a port engagement member and to provide fluid communication between the fluid chamber and the port engagement member.

6. The fluid container according to claim 1, further comprising:

a guide member disposed on the one wall portion of the housing unit, the guide member configured to engage the respective receiver slot and guide the housing unit therein during installation of the fluid container in the receiving unit.

7. The fluid container according to claim 1, wherein after installation of the fluid container in the receiving unit, the other wall portion of the housing unit is positioned at a furthest point along the installation path of the fluid container.

8. The fluid container according to claim 1, wherein the angle is in a range of 85 to 95 degrees.

9. The fluid container according to claim 1, wherein the second key set includes at least one second key projection extending along the installation path into the respective receiver slot.

10. The fluid container according to claim 1, wherein at least a portion of the first key set is color-coded to correspond to a respective color of fluid in the fluid chamber.

11. A fluid container usable with an image forming apparatus including a receiving unit having a plurality of receiver slots, the fluid container comprising:

a housing unit including a plurality of wall portions and a fluid chamber configured to store fluid therein, the housing unit configured to removably attach to a respective receiver slot of the receiving unit of the image forming apparatus;

a first key set disposed on an exterior surface of one wall portion and a second key set disposed on an exterior surface of an other wall portion of the housing unit, the first key set configured to form a first key pattern corresponding to a conforming first receiver key pattern and the second key set configured to form a second key pattern corresponding to a conforming second receiver key pattern of the respective receiver slot of the receiving unit;

a port disposed on the other wall portion of the housing unit adjacent to the second key set, wherein the port is configured to engage a port engagement member and to provide fluid communication between the fluid chamber and the port engagement member; and a guide member disposed on the one wall portion of the housing unit, wherein the guide member is configured to engage the respective receiver slot and guide the housing unit therein along a linear installation path during installation of the fluid container in the receiving unit, wherein, during installation of the fluid container in the receiving unit, the other wall portion including the second key set is to be a first portion of the fluid container to enter the respective receiver slot along the linear installation path of the fluid container, wherein, before completion of the linear installation path of the fluid container, the first key pattern is to engage and continue past the first receiver key pattern, wherein the second key pattern is to fully engage the second receiver key pattern upon completion of the linear installation path of the fluid container, and wherein, after installation of the fluid container in the receiving unit, the other wall portion of the housing unit is positioned at a furthest point along the installation path of the fluid container.

12. The fluid container according to claim 11, wherein the other wall portion of the housing unit is positioned closer to at least a portion of the guide member than the other wall portion is to the first key set.

13. The fluid container according to claim 11, wherein the first key set comprises at least one of one or more projections and one or more projection receiving areas to conform to the conforming first receiver key pattern of the respective receiver slot of the receiving unit and the second key set comprises at least one or more projections and one or more projection receiving areas to conform to the conforming second receiver key pattern of the respective receiver slot of the receiving unit.

14. The fluid container according to claim 13, wherein each of the first key set and the conforming first key pattern comprises a combination of three projections and three projection receiving areas such that the three projections of the first key set correspond to the three projection receiving areas of the respective receiver slot of the receiving unit, respectively, and the three projection receiving areas of the first key set correspond to the three projections of the respective receiver slot of the receiving unit, respectively.

15. The fluid container according to claim 11, wherein the one wall portion and the other wall portion of the housing unit are joined at an angle in a range of 85 to 95 degrees.

16. A fluid container usable with an image forming apparatus including a receiving unit having a plurality of receiver slots, the fluid container comprising:

a housing unit including one wall portion, another wall portion, and a fluid chamber to store fluid therein, the housing unit to removably attach to a respective receiver slot of the receiving unit of the image forming apparatus;

a first key set disposed on the one wall portion and to form a first key pattern corresponding to a conforming first receiver key pattern of a respective receiver slot; and a second key set disposed on the other wall portion and to form a second key pattern corresponding to a conforming second receiver key pattern of the respective receiver slot, wherein the fluid container is to be installed in the receiving unit along an installation path, wherein the other wall portion including the second key set is to be a first portion of the fluid container to enter the respective receiver slot during installation along the installation path, wherein the second key set includes at least one second key projection extending along the installation path into the respective receiver slot, wherein, before completion of the installation path of the fluid container, the first key pattern is to engage and continue past the first receiver key pattern, wherein the second key pattern is to fully engage the second receiver key pattern upon completion of the installation path of the fluid container, and wherein the installation path of the fluid container is a straight line into the respective receiver slot.

17. The fluid container according to claim 16, wherein the first key set comprises at least one or more projections and one or more projection receiving areas to conform to the conforming first receiver key pattern and the second key set comprises at least one or more projections and one or more projection receiving areas to conform to the conforming second receiver key pattern.

18. The fluid container according to claim 17, wherein each of the first key set and the conforming first key pattern comprises a combination of three projections and three projection receiving areas such that the three projections of the first key set correspond to the three projection receiving areas of the respective receiver slot of the receiving unit, respectively, and the three projection receiving areas of the first key set correspond to the three projections of the respective receiver slot of the receiving unit, respectively.

19. The fluid container according to claim 18, further comprising:

a port disposed on the other wall portion of the housing unit adjacent to the second key set, wherein the port is configured to engage a port engagement member and to provide fluid communication between the fluid chamber and the port engagement member.

20. The fluid container according to claim 16, further comprising:

a guide member disposed on the one wall portion of the housing unit, the guide member configured to engage the respective receiver slot and guide the housing unit therein during installation of the fluid container in the receiving unit.

* * * * *